US011833656B2

(12) United States Patent
Oishi et al.

(10) Patent No.: US 11,833,656 B2
(45) Date of Patent: Dec. 5, 2023

(54) CHAIN SAW

(71) Applicant: MAKITA CORPORATION, Anjo (JP)

(72) Inventors: Kohei Oishi, Anjo (JP); Ryo Sunazuka, Anjo (JP); Yoshifumi Watanabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/551,478

(22) Filed: Dec. 15, 2021

(65) Prior Publication Data

US 2022/0203513 A1 Jun. 30, 2022

(30) Foreign Application Priority Data

Dec. 24, 2020 (JP) ..... 2020-214589

(51) Int. Cl.

| | |
|---|---|
| ***B27B 17/08*** | (2006.01) |
| ***B27B 17/02*** | (2006.01) |
| ***B27B 17/12*** | (2006.01) |
| ***B25F 5/00*** | (2006.01) |

(52) U.S. Cl.

CPC ..... *B25F 5/008* (2013.01); *B27B 17/02* (2013.01); *B27B 17/08* (2013.01); *B27B 17/12* (2013.01)

(58) Field of Classification Search

CPC ..... B27B 17/00; B27B 17/02; B27B 17/12; B28D 1/082; F16N 13/06

See application file for complete search history.

(56) References Cited

FOREIGN PATENT DOCUMENTS

| | | | |
|---|---|---|---|
| EP | 0847840 | A2 * | 6/1998 |
| JP | 2009-279884 | A | 12/2009 |
| JP | 2009279884 | A * | 12/2009 |

* cited by examiner

*Primary Examiner* — Jennifer S Matthews
(74) *Attorney, Agent, or Firm* — Sughrue Mion, PLLC

(57) ABSTRACT

A chain saw may include a saw chain, a guide bar to which the saw chain is attached, a sprocket configured to run the saw chain along a periphery of the guide bar, a prime mover configured to rotate the sprocket, an oil tank configured to store oil to be supplied to the saw chain, a housing that houses the prime mover and the oil tank, a bolt protruding from the housing and penetrating a hole disposed in the guide bar, a nut screwed onto the bolt to fix the guide bar to the housing, and a heat dissipating structure configured to dissipate heat from the bolt to the oil in the oil tank.

12 Claims, 12 Drawing Sheets

CHAIN SAW

CROSS-REFERENCE TO RELATED APPLICATION

This application claims priority to Japanese Patent Application No. 2020-214589 filed on Dec. 24, 2020, the entire contents of which are hereby incorporated by reference into the present application.

TECHNICAL FIELD

This disclosure herewith relates to a chain saw.

BACKGROUND

Japanese Patent Application No. 2009-279884 describes a chain saw. The chain saw includes a saw chain, a guide bar to which the saw chain is attached, a sprocket that runs the saw chain along a periphery of the guide bar, a prime mover that rotates the sprocket, an oil tank that stores oil to be supplied to the saw chain, a housing that houses the prime mover and the oil tank, a bolt protruding from the housing and penetrates a hole disposed in the guide bar, and a nut that is screwed onto the bolt to fix the guide bar to the housing.

SUMMARY

When cutting an object to be cut using a chain saw, frictional heat between a running saw chain and a guide bar causes the guide bar to have a high temperature. In the above configuration, heat of the guide bar is transferred to the nut, thereby the nut has a high temperature. There is a possibility that an operator touches the nut having a high temperature. The present disclosure provides a technique that enables to suppress a nut from having a high temperature.

The present disclosure discloses a chain saw. The chain saw may comprise: a saw chain; a guide bar to which the saw chain is attached; a sprocket configured to run the saw chain along a periphery of the guide bar; a prime mover configured to rotate the sprocket; an oil tank configured to store oil to be supplied to the saw chain; a housing that houses the prime mover and the oil tank; a bolt protruding from the housing and penetrating a hole disposed in the guide bar; a nut screwed onto the bolt to fix the guide bar to the housing; and a heat dissipating structure configured to dissipate heat from the bolt to the oil in the oil tank.

In the above configuration, the heat of the nut is transferred to the bolt, and the heat dissipating structure dissipates the heat of the bolt to the oil in the oil tank, so that it is possible to suppress the bolt from having a high temperature. As a result, it is possible to suppress the nut from having a high temperature.

DETAILED DESCRIPTION

Figure 1:
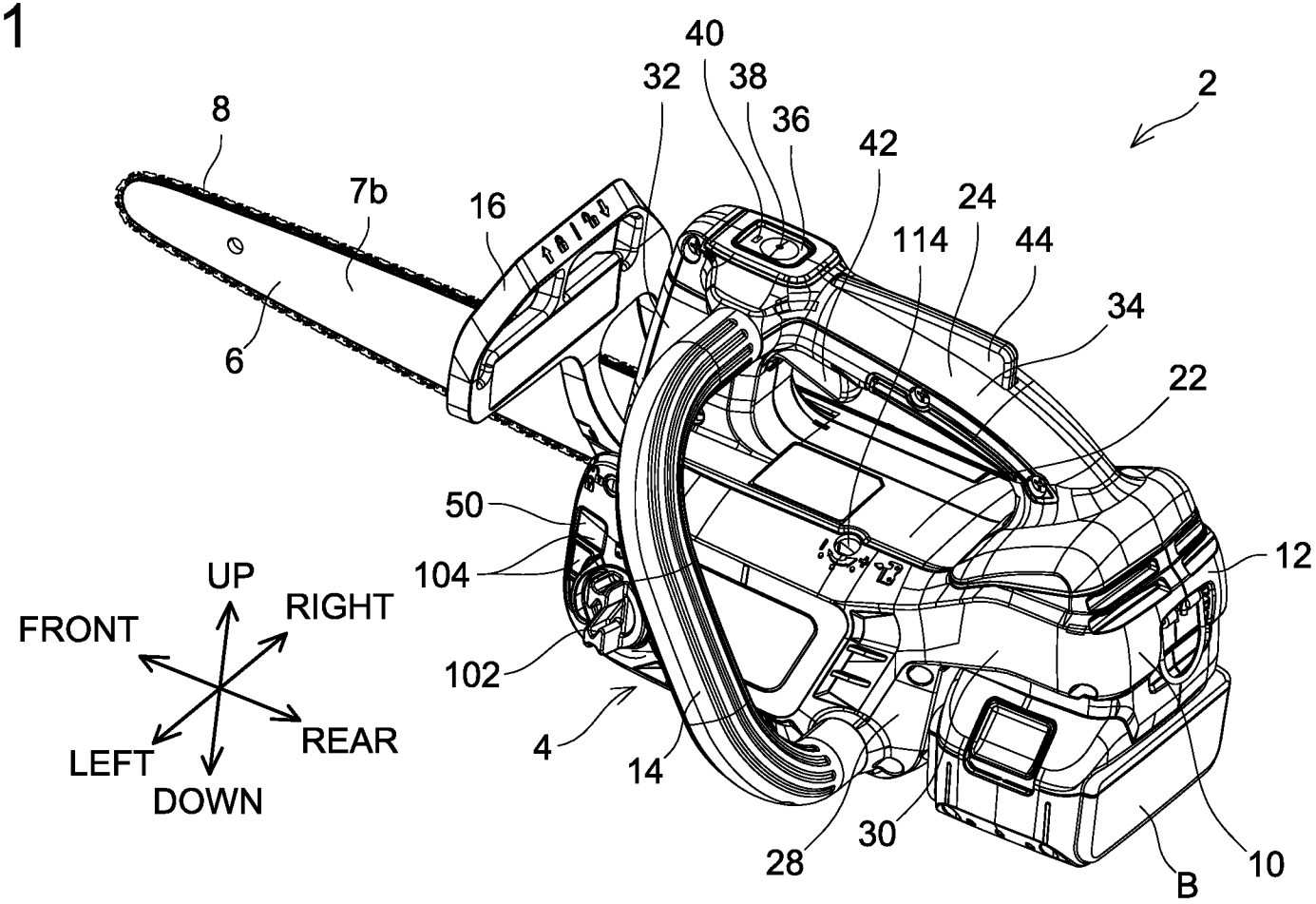
FIG. 1 is a perspective view of a chain saw 2 of a first embodiment as viewed from the rear left side.

Representative, non-limiting examples of the present disclosure will now be described in further detail with reference to the attached drawings. This detailed description is merely intended to teach a person of skill in the art further details for practicing preferred aspects of the present teachings and is not intended to limit the scope of the present disclosure. Furthermore, each of the additional features and teachings disclosed below may be utilized separately or in conjunction with other features and teachings to provide improved chain saws, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, the heat dissipating structure may comprise a heat dissipating member, wherein at least a part of the heat dissipating member is disposed in the oil tank.

In the above configuration, the at least a part of the heat dissipating member is in contact with the oil in the oil tank, by which the heat of the heat dissipating member is dissipated to the oil. Therefore, it is possible to suppress the nut from having a high temperature.

In one or more embodiments, the heat dissipating member may comprise a heat dissipating fin constituted of a metallic material.

In the above configuration, as compared with the case where the heat dissipating member does not comprise the heat dissipating fin, an area where the heat dissipating member is in contact with the oil in the oil tank can be increased, so that the heat of the heat dissipating member is easily dissipated to the oil. Therefore, it is possible to further suppress the nut from having a high temperature.

In one or more embodiments, the heat dissipating member may comprise a flexible member constituted of a metallic material and hanging in a direction of gravity regardless of a posture of the chain saw.

In the above configuration, since the flexible member can come into contact with the oil in the oil tank regardless of the posture of the chain saw, the heat of the heat dissipating member is easily dissipated to the oil. Therefore, it is possible to further suppress the nut from having a high temperature.

In one or more embodiments, a liquid surface of the oil may be located above a lower end of the at least a part of the heat dissipating member in a state in which the chain saw is placed on a ground surface when the oil having an oil amount corresponding to a first ratio of a capacity of the oil tank is stored in the oil tank.

In the above configuration, if the oil having the oil amount corresponding to the first ratio of the capacity of the oil tank is stored in the oil tank, the heat dissipating member can come into contact with the oil in the oil tank when the chain saw is in the same posture as when the chain saw is placed on the ground, so that the heat of the heat dissipating member can be easily dissipated to the oil. Therefore, it is possible to further suppress the nut from having a high temperature.

In one or more embodiments, the first ratio may be equal to or less than 50% of the capacity of the oil tank.

In order to prevent shortage of the oil in the oil tank while working by using the chain saw, a sufficient amount of oil is usually stored in the oil tank. However, when the chain saw is continuously used for a long period of time, the oil amount in the oil tank may decrease to an amount corresponding to equal to or less than 50% of the capacity of the oil tank. In the above configuration, even when the chain saw is continuously used for a long period of time, the heat dissipating member can be brought into contact with the oil in the oil tank when the chain saw is in the same posture as when the chain saw is placed on the ground, and the heat of the heat dissipating member can be easily dissipated to the oil. Therefore, it is possible to further suppress the nut from having a high temperature.

In one or more embodiments, the at least a part of the heat dissipating member may include a portion disposed in the oil tank and disposed away from an inner surface of the oil tank by at least 10% of a length of the oil tank with respect to a direction in which the bolt extends.

In the above configuration, by disposing the at least a part of the heat dissipating member in a position deep in the oil tank, an area where the heat dissipating member is in contact with the oil in the oil tank can be increased, so that the heat of the heat dissipating member can be easily dissipated to the oil. Therefore, it is possible to further suppress the nut from having a high temperature.

In one or more embodiments, the bolt may penetrate the oil tank from an outside of the oil tank to an inside of the oil tank. A portion of the bolt inside the oil tank may constitute the heat dissipating structure. The portion of the bolt inside the oil tank may include a portion disposed in the oil tank and disposed away from an inner surface of the oil tank by at least 10% of a length of the oil tank with respect to a direction in which the bolt extends.

In the above configuration, by disposing the bolt in a position deep inside the oil tank, an area where the bolt is in contact with the oil in the oil tank can be increased, so that the heat of the bolt can be easily dissipated to the oil. As a result, it is possible to further suppress the nut from having a high temperature.

In one or more embodiments, a liquid surface of the oil may be located above a lower end of the portion of the bolt inside the oil tank in a state in which the chain saw is placed on a ground surface when the oil having an oil amount corresponding to a first ratio of a capacity of the oil tank is stored in the oil tank.

In the above configuration, if the oil tank contains the oil having an oil amount corresponding to the first ratio of the capacity of the oil tank, the bolt can come into contact with the oil in the oil tank when the chain saw is in the same posture as when the chain saw is placed on the ground, so that the heat of the bolt can be easily dissipated to the oil. As a result, it is possible to further suppress the nut from having a high temperature.

In one or more embodiments, the first ratio may be equal to or less than 50% of the capacity of the oil tank.

In the above configuration, even when the chain saw is continuously used for a long period of time and the oil amount in the oil tank decreases to equal to or less than 50% of the capacity of the oil tank, the bolt can be brought into contact with the oil when the chain saw is in the same posture as when the chain saw is placed on the ground, and the heat of the bolt can be easily dissipated to the oil. As a result, it is possible to further suppress the nut from having a high temperature.

In one or more embodiments, the guide bar may comprise a cutting part disposed between the housing and a front end of the guide bar in a longitudinal direction of the guide bar. A length of the cutting part in the longitudinal direction may be equal to or less than 250 mm.

Generally, the shorter the length of the cutting part, the greater the curvature of the periphery of the guide bar 6. For this reason, frictional heat between the saw chain and the guide bar increases, and the guide bar tends to have a higher temperature. In the above configuration, the heat transferred from the guide bar having a higher temperature to the bolt can be dissipated to the oil in the oil tank through the heat dissipating structure. As a result, it is possible to suppress the nut from having a high temperature.

In one or more embodiments, the prime mover may be a motor.

In the above configuration, as compared with the case where the prime mover is an engine, the body housing does not tend to have portion(s) having a high temperature, and thus there is a high risk that the operator touches the nut without paying attention. In the above configuration, since the heat dissipating structure dissipates the heat of the bolt to the oil in the oil tank, it is possible to suppress the nut from having a high temperature.

In one or more embodiments, the chain saw may comprise a battery pack configured to be detachably attached to the housing. The motor may be configured to operate using electric power supplied from the battery pack.

In the above configuration, since the power cable is unnecessary, it is easy to handle the chain saw 2, but there is a high risk that the operator touches the nut without paying attention. In the above configuration, since the heat dissipating structure dissipates the heat of the bolt to the oil in the oil tank 50, it is possible to suppress the nut from having a high temperature.

First Embodiment

A chain saw 2 of a first embodiment will be described with reference to FIGS. 1 to 8. The chain saw 2 includes a body 4, a guide bar 6, and a saw chain 8. The guide bar 6 has an elongated plate shape. The guide bar 6 is attached to the body 4 such that it protrudes forward from the body 4. The saw chain 8 includes a plurality of cutters connected to each other. The saw chain 8 is attached along a periphery of the guide bar 6. The battery pack B is attached to the body 4. The chain saw 2 drives the saw chain 8 to rotate along the periphery of the guide bar 6 by the power supplied from the battery pack B, and cuts an object to be cut such as wood. In the following description, as illustrated in FIG. 3, when the chain saw 2 is placed on the placement surface P such as the ground, a direction orthogonal to the placement surface P is referred to as an up-down, a direction obtained by projecting the longitudinal direction of the guide bar 6 on the placement surface P is referred to as a front-rear direction, and a direction orthogonal to the up-down direction and the front-rear direction is referred to as a left-right direction. In the drawings except FIGS. 1, 2, and 4, illustration of the saw chain 8 is omitted for clear illustration.

Figure 2:
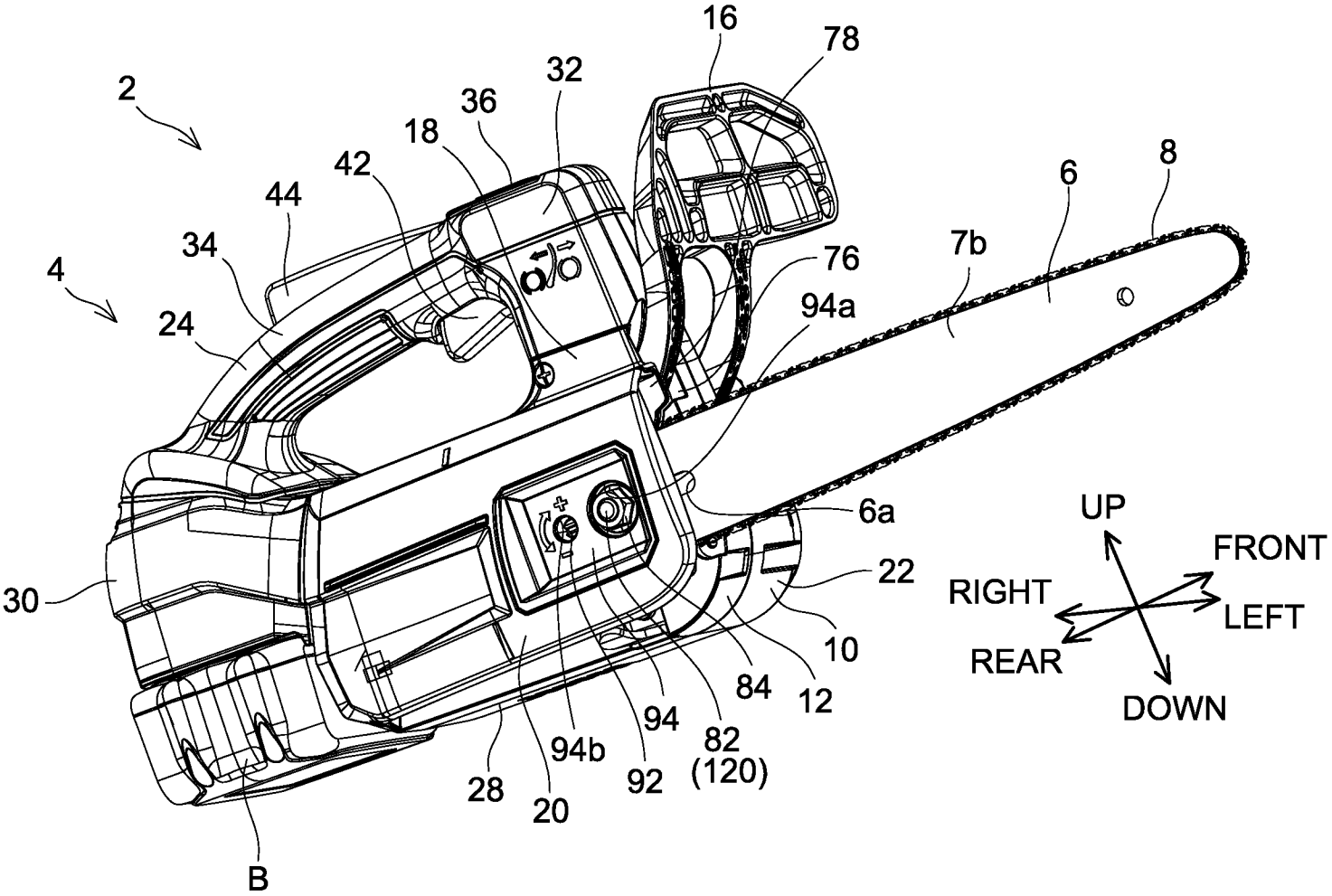
FIG. 2 is a perspective view of the chain saw 2 of the first embodiment as viewed from the front right side.
Figure 3:
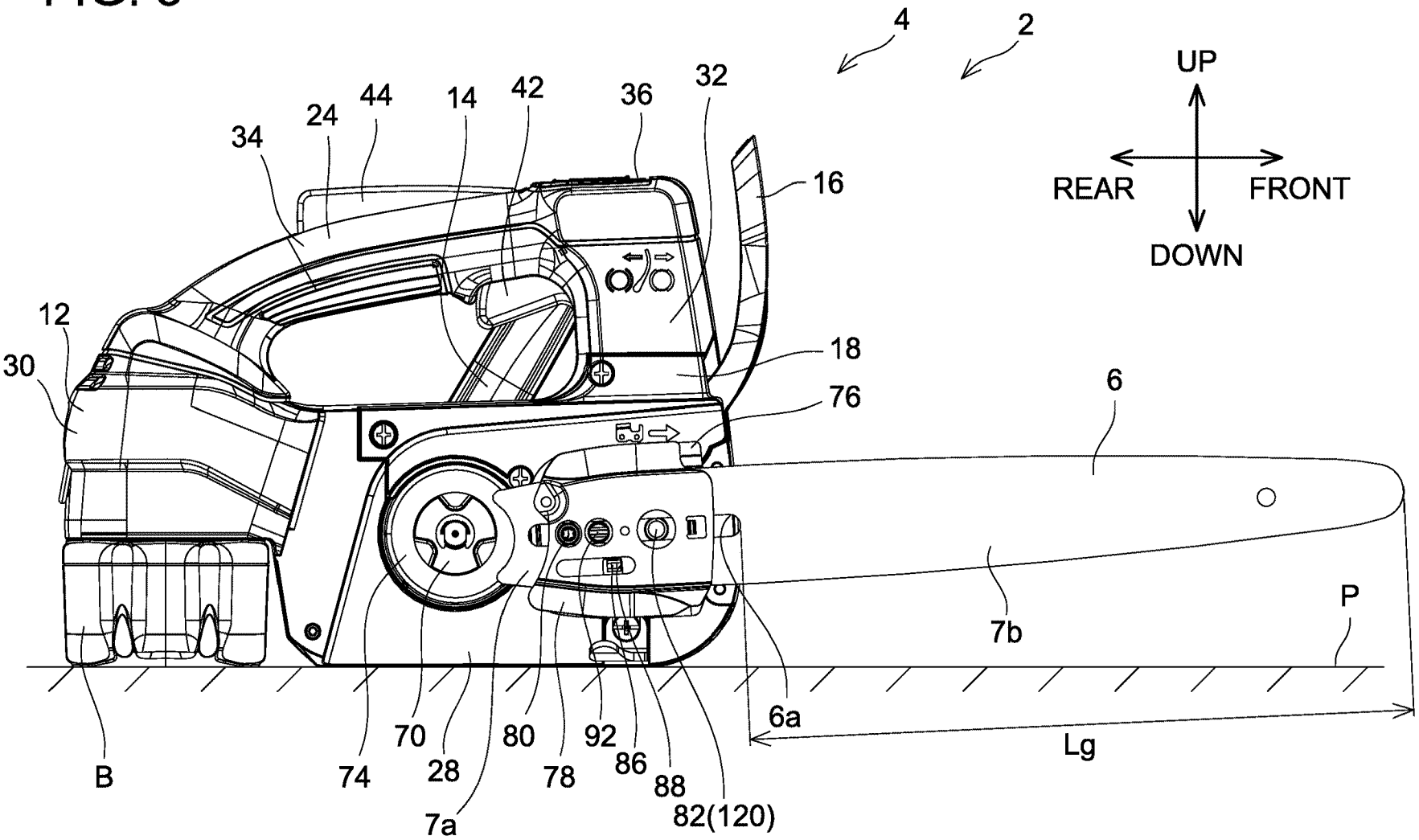
FIG. 3 is a right side view of the chain saw 2 of the first embodiment with a sprocket cover 20 detached.

As illustrated in FIGS. 1 and 2, the body 4 includes a left housing 10, a right housing 12, a side handle 14, a hand guard 16, a brake cover 18, and a sprocket cover 20. The left housing 10 and the right housing 12 constitute a body housing 22 and a top handle 24. The left housing 10 defines outer shapes of left surfaces of the body housing 22 and the top handle 24, and the right housing 12 defines outer shapes of right surfaces of the body housing 22 and the top handle 24.

As illustrated in FIG. 3, the guide bar 6 is attached to the right housing 12. The guide bar 6 includes an attaching part 7*a* facing the right housing 12 and a cutting part 7*b* protruding forward from the right housing 12. In the longitudinal direction of the guide bar 6, a length Lg of the cutting part 7*b* is 200 mm. Here, the length Lg refers to a length from the boundary between the attaching part 7*a* and the cutting part 7*b* to the front end of the cutting part 7*b*. In the longitudinal direction of the guide bar 6, the position of the boundary between the attaching part 7*a* and the cutting part 7*b* is equal to the position of the front end of the right housing 12. In a variant, the length Lg of the cutting part 7*b* may be any value of 250 mm or less in the longitudinal direction of the guide bar 6.

Figure 4:
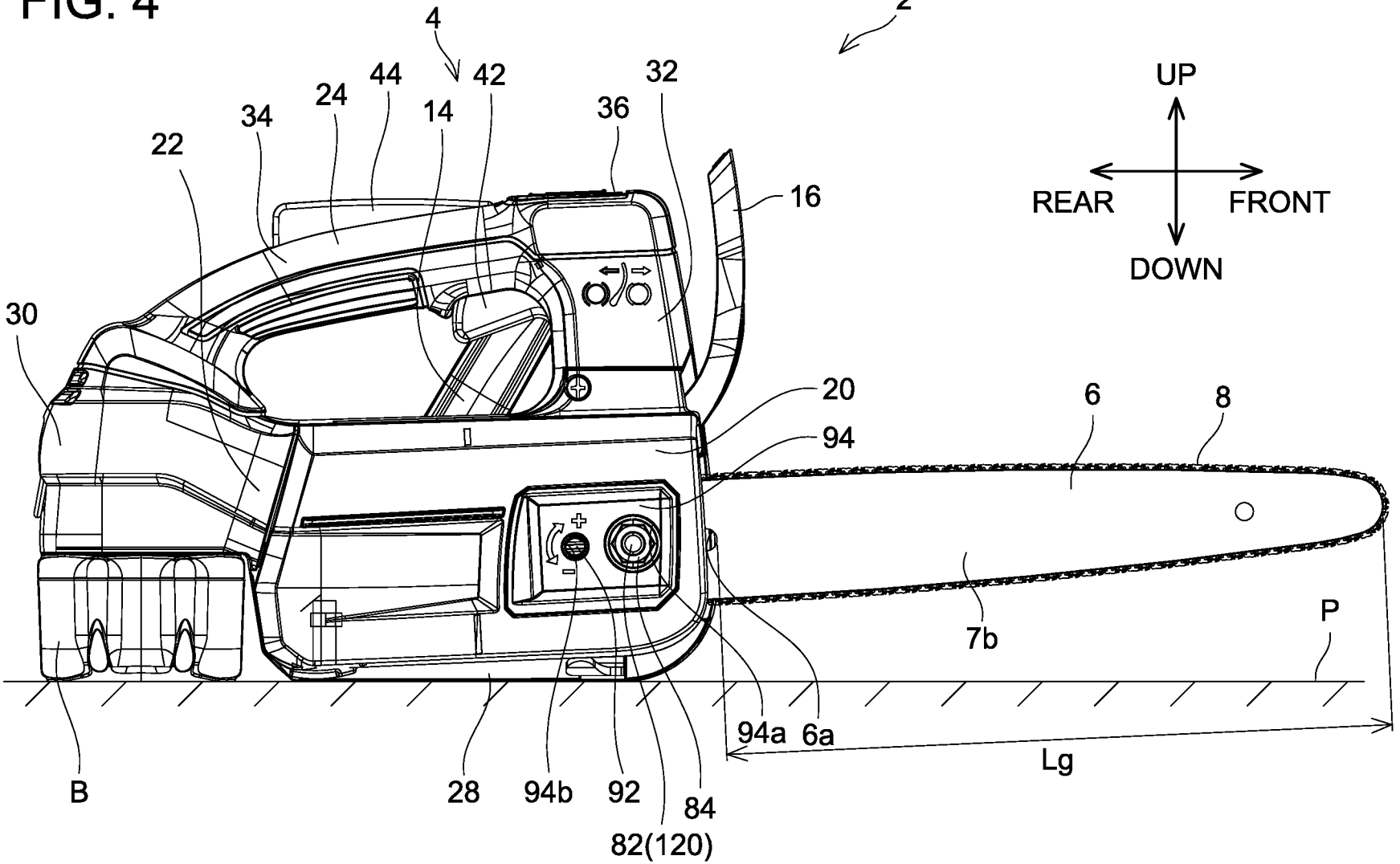
FIG. 4 is a right side view of the chain saw 2 of the first embodiment.

As illustrated in FIG. 4, the body housing 22 includes a front body housing 28 having a substantially rectangular parallelepiped shape having its longitudinal direction in the front-rear direction of the body 4, and a rear body housing 30 extending rearward from an upper portion of a rear surface of the front body housing 28. The battery pack B is detachably attached to a lower surface of the rear body housing 30. When the chain saw 2 is placed on the placement surface P with the battery pack B attached to the chain saw 2, a lower surface of the front body housing 28 comes into contact with the placement surface P, and a lower surface of the battery pack B also comes into contact with the placement surface P.

As illustrated in FIG. 1, the top handle 24 includes a support 32 having a substantially prismatic shape and a grip 34 having a substantially cylindrical shape. The support 32 extends upward from a front portion of an upper surface of the front body housing 28. A recess 36 is defined in an upper surface of the support 32. Inside the recess 36, a power switch 38 for an operator to switch on and off the power of the chain saw 2, and a power lamp 40 configured to display on and off states of the power of the chain saw 2 are arranged. The grip 34 extends rearward from an upper portion of a rear surface of the support 32, curves downward, and is connected to an upper surface of the rear body housing 30. A trigger switch 42 for an operator to operate rotational driving of the saw chain 8 is disposed at a front portion of a lower surface of the grip 34. A trigger lock lever 44 that switches between a state permitting an operation of the trigger switch 42 by the operator and a state prohibiting the operation is disposed at an upper portion of the grip 34.

The side handle 14 has a substantially U-shaped outer shape connecting an upper portion of the left surface of the support 32 of the top handle 24 and a rear portion of the left surface of the front body housing 28. The cross-sectional shape of the side handle 14 is substantially circular. When using the chain saw 2, the operator holds the chain saw 2 by holding the top handle 24 with his/her right hand and holding the side handle 14 with his/her left hand. From this state, when the operator pushes the trigger lock lever 44 of the top handle 24 with the palm of his/her right hand, the operation of the trigger switch 42 by the operator is permitted. With the trigger lock lever 44 pushed, when the operator pulls the trigger switch 42 with the index finger of his/her right hand, the saw chain 8 is driven to rotate.

Figure 5:
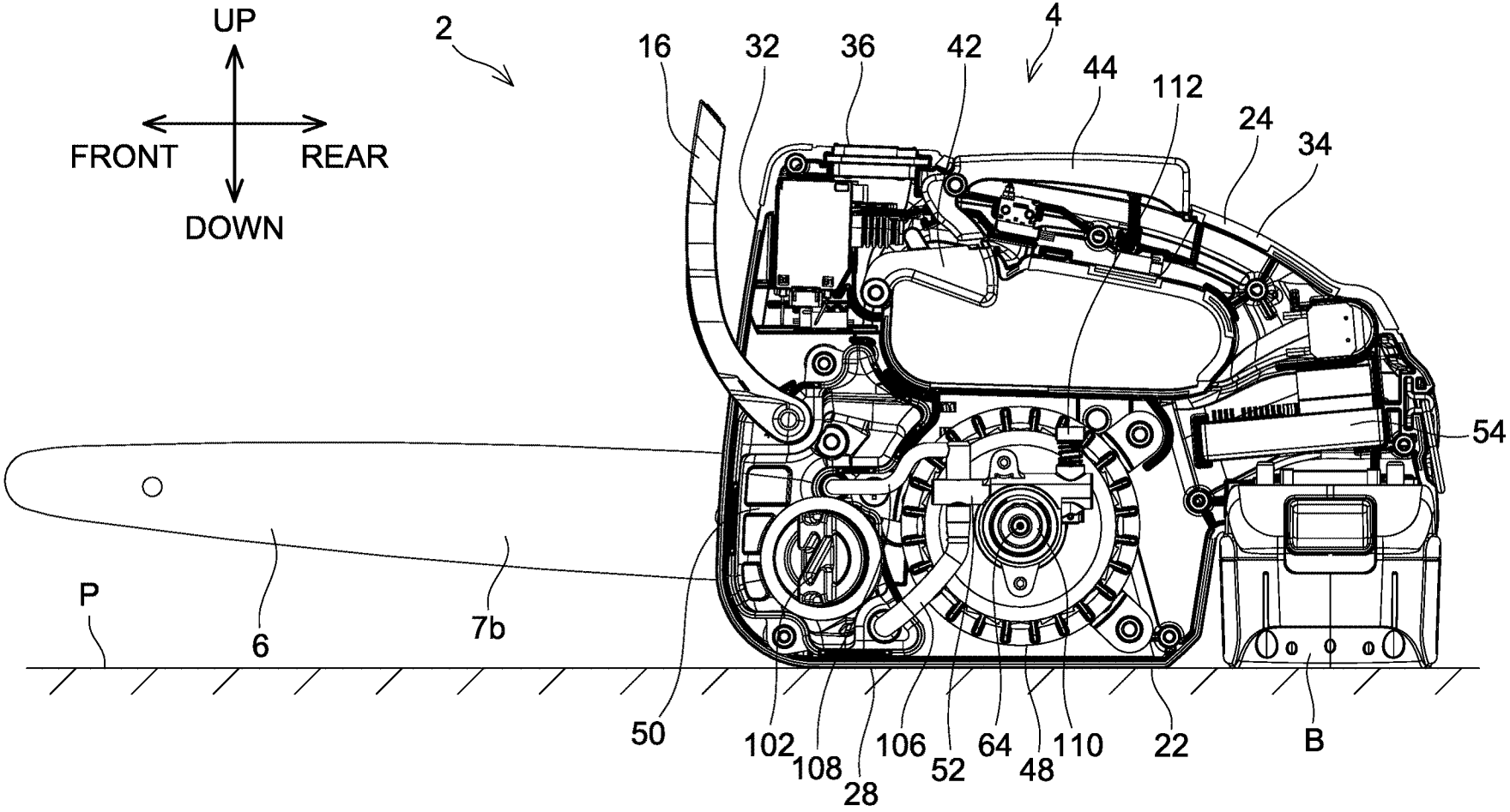
FIG. 5 is a left side view of the chain saw 2 of the first embodiment with a side handle 14 and a left housing 10 detached.

As illustrated in FIG. 5, the chain saw 2 includes a motor 48, an oil tank 50, an oil pump 52, and a control unit 54. The motor 48, the oil tank 50, and the oil pump 52 are disposed inside the front body housing 28. The control unit 54 is disposed inside the rear body housing 30.

Figure 6:
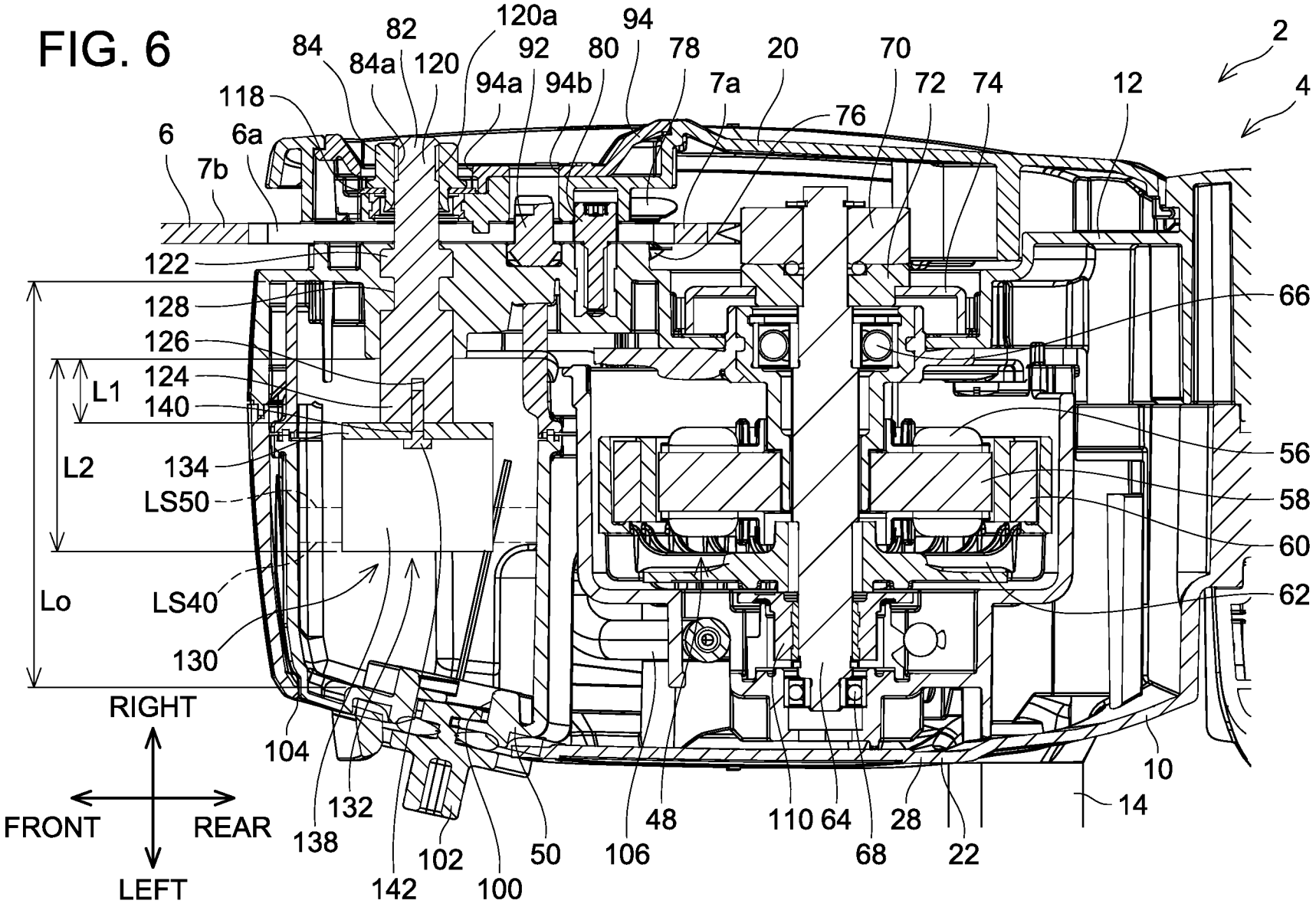
FIG. 6 is a horizontal cross-sectional view of the chain saw 2 of the first embodiment.

As illustrated in FIG. 6, the motor 48 is a DC brushless motor of outer rotor type. The motor 48 includes a stator 58 around which a coil 56 is wound, a rotor 60 disposed outward of the stator 58, a cooling fan 62 fitted to the rotor 60, and a shaft 64 disposed to pass through centers of the stator 58 and the rotor 60 and fitted to the cooling fan 62. The stator 58 is fixed to the body housing 22. The coil 56 is electrically connected to the control unit 54 (see FIG. 5). The shaft 64 is disposed along the left-right direction of the chain saw 2, and is rotatably supported with respect to the body housing 22 via bearings 66 and 68. The bearing 66 is disposed rightward of the stator 58, and the bearing 68 is disposed leftward of the stator 58 and the cooling fan 62. A sprocket 70 and a brake base 72 are fixed to the vicinity of the right end of the shaft 64. The sprocket 70 and the brake base 72 are disposed rightward of the bearing 66. A brake drum 74 is fitted to the brake base 72.

As illustrated in FIG. 3, the sprocket 70 is exposed to the outside of the right housing 12. The saw chain 8 (see FIGS. 1, 2, and 4) is passed from the guide bar 6 to the sprocket 70. When the motor 48 operates, the sprocket 70 rotates together with the shaft 64. As a result, the saw chain 8 rotates around the sprocket 70 and the guide bar 6.

The guide bar 6 is fixed to the right housing 12 while held between an inner guide plate 76 and an outer guide plate 78. The inner guide plate 76 has a shape in which the vicinity of its upper end and the vicinity of its lower end are curved toward the left side. The outer guide plate 78 has a shape in which the vicinity of its upper end and the vicinity of its lower end are curved toward the right side. A long hole 6*a* extending along the longitudinal direction of the guide bar 6 is defined in the attaching part 7*a* of the guide bar 6. The guide bar 6 is supported by the body housing 22 via a support pin 80 and a bolt 82 penetrating the long hole 6*a*. As illustrated in FIGS. 2 and 4, a nut 84 is screwed onto the bolt 82 from the outside of the sprocket cover 20 and the outer guide plate 78. The operator can adjust the tension in the saw chain 8 by changing the distance between the guide bar 6 and the sprocket 70 by sliding the guide bar 6 along the long hole 6*a* with the nut 84 loosened.

Figure 7:
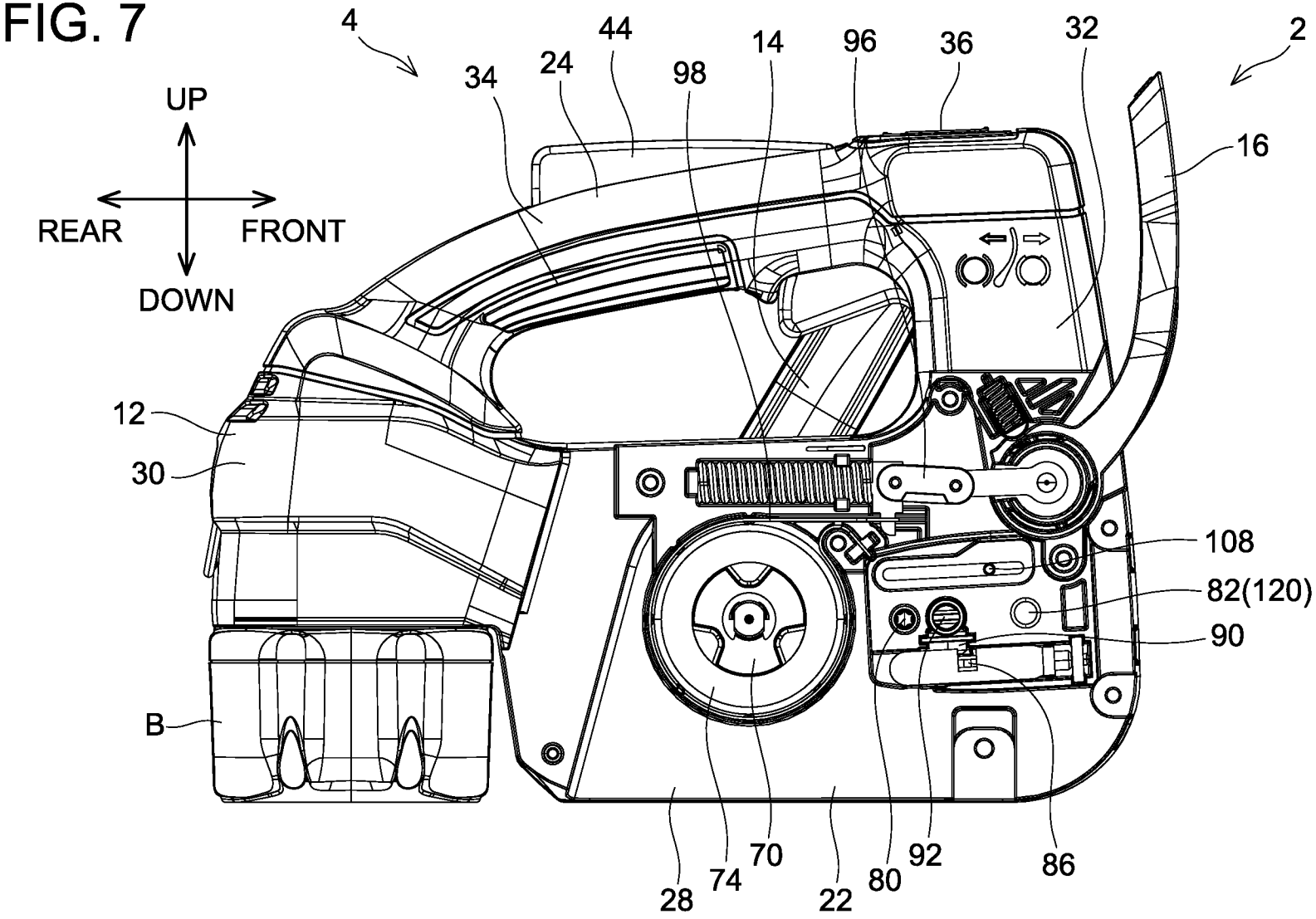
FIG. 7 is a right side view of the chain saw 2 of the first embodiment with the sprocket cover 20, a guide bar 6, and a brake cover 18 detached.

As illustrated in FIG. 3, an engagement hole 88 which engages with an engaging claw 86 is defined in the guide bar 6. As illustrated in FIG. 7, the engaging claw 86 is coupled to an adjusting screw 92 via a rotation linear motion converting mechanism 90. The rotation linear motion converting mechanism 90 converts the rotational motion of the adjusting screw 92 into a linear motion in a direction along the long hole 6*a* of the engaging claw 86. As illustrated in FIG. 6, the adjusting screw 92 penetrates the long hole 6*a* without contacting an inner peripheral surface of the long hole 6*a*. When the operator rotates the adjusting screw 92, the engaging claw 86 moves in the direction along the long hole 6*a* of the guide bar 6, and the guide bar 6 slides in the direction along the long hole 6*a*.

As illustrated in FIGS. 2 and 4, the sprocket 70, the inner guide plate 76, the outer guide plate 78, and the support pin 80 are covered by the sprocket cover 20. An outer cover 94 is attached to the sprocket cover 20. A fastening opening 94*a* for externally accessing the nut 84 fastened to the bolt 82, and an adjusting opening 94*b* for externally accessing the adjusting screw 92 are defined in the outer cover 94. The operator can tighten or loosen the nut 84 with the sprocket cover 20 attached. In addition, the operator can adjust the tension in the saw chain 8 by rotating the adjusting screw 92 with the sprocket cover 20 attached.

As illustrated in FIG. 7, the hand guard 16 is coupled to a brake shoe 98 via a link mechanism 96. The hand guard 16 is swingable about a swing shaft that is along the left-right direction. The brake shoe 98 is disposed so as to surround the periphery of the brake drum 74. The link mechanism 96 reduces the diameter of the brake shoe 98 when the hand guard 16 is tilted forward, and increases the diameter of the brake shoe 98 when the hand guard 16 is moved rearward. When the diameter of the brake shoe 98 decreases, an inner peripheral surface of the brake shoe 98 and an outer peripheral surface of the brake drum 74 come into contact with each other, and the rotation of the shaft 64 is confined by the frictional force between them.

The oil tank 50 illustrated in FIG. 5 stores oil for lubricating the saw chain 8. The oil tank 50 is disposed frontward of the motor 48 and the oil pump 52. As illustrated in FIG. 6, the oil tank 50 has its longitudinal direction in the left-right direction. The oil tank 50 is made of a resin material. The right end of the oil tank 50 is welded to an inner surface of the right housing 12. As a result, a space for housing the oil is defined between the inner surface of the oil tank 50 and the inner surface of the right housing 12. The right housing 12 constitutes a part of the oil tank 50. Hereinafter, a portion of the right housing 12 defining the space inside the oil tank 50 may be described as a part of the oil tank 50. Since the right end of the oil tank 50 is closed by the inner surface of the right housing 12, the oil does not leak out of the oil tank 50. In a variant, the oil tank 50 may be formed integrally with the right housing 12. A refill opening 100 for refiling oil to the oil tank 50 is defined in a left side surface of the oil tank 50. The refill opening 100 is provided with a detachable cap 102. As illustrated in FIG. 1, the cap 102 of the oil tank 50 is exposed to the outside of the left housing 10 and is disposed at the lower portion of the left surface of the front body housing 28. Recognition openings 104 through which a liquid surface in the oil tank 50 can be visually recognized from the outside are defined frontward of the cap 102.

Figure 8:
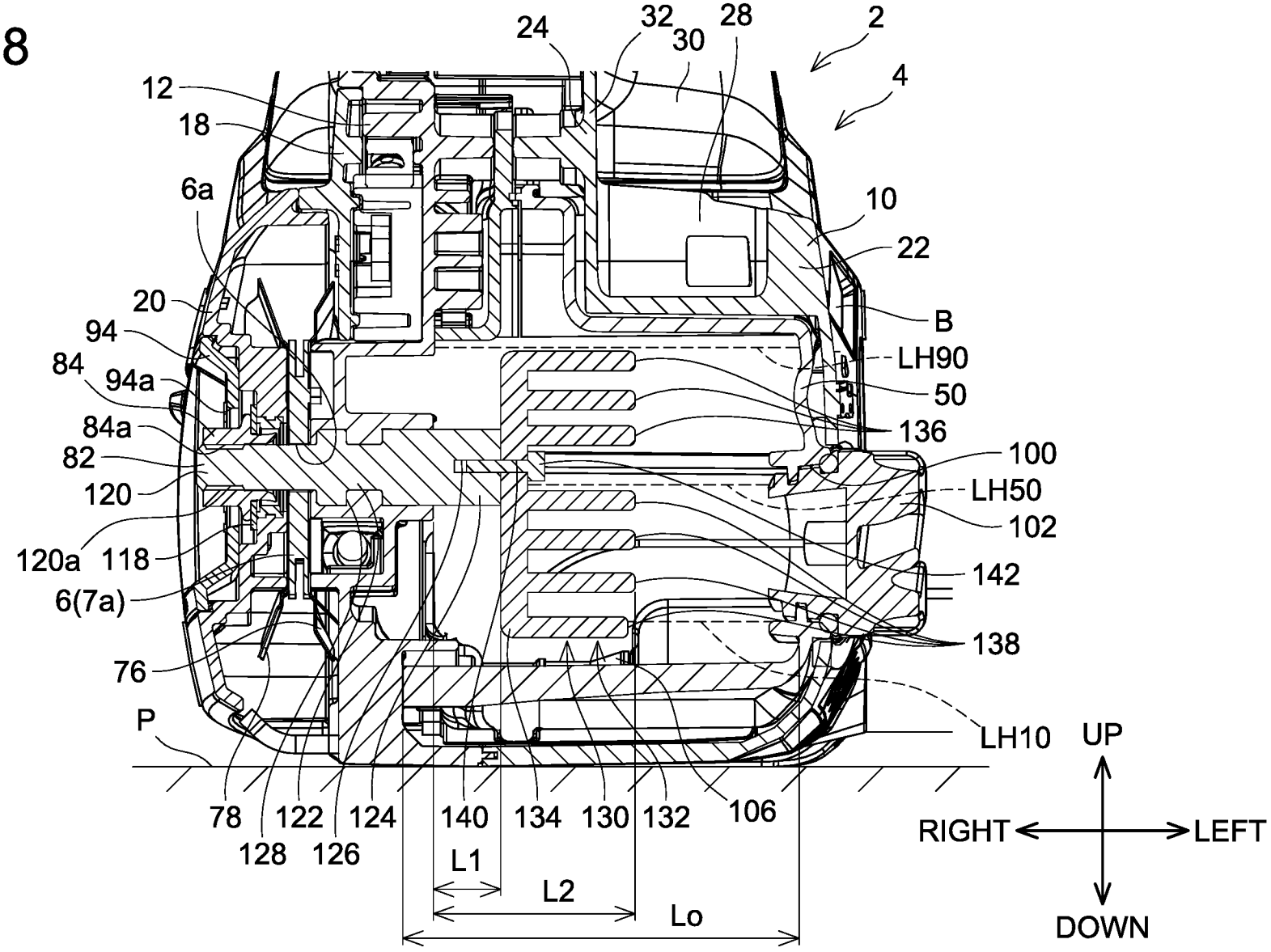
FIG. 8 is a vertical cross-sectional view of the chain saw 2 of the first embodiment.

The oil pump 52 illustrated in FIG. 5 pumps the oil from the oil tank 50 through an entrance guide pipe 106 and pumps out the oil toward the guide bar 6 through an exit guide pipe 108 in conjunction with the rotation of the motor 48. As illustrated in FIG. 8, an entrance guide opening (not shown) for pumping the oil from the oil tank 50 is defined at the end of the entrance guide pipe 106, and the entrance guide opening is disposed in the vicinity of a lower surface of the oil tank 50 in the oil tank 50. As illustrated in FIG. 5, a worm gear 110 for driving the oil pump 52 is fitted to the vicinity of the left end of the shaft 64 of the motor 48. As illustrated in FIG. 6, the worm gear 110 is disposed leftward of the stator 58 and the cooling fan 62 and rightward of the bearing 68. A discharge amount of the oil supplied from the oil tank 50 to the guide bar 6 by the oil pump 52 can be adjusted via an adjustment pin 112 (see FIG. 5).

As illustrated in FIG. 1, an adjustment opening 114 that allows to externally access the adjustment pin 112 is defined in the upper surface of the body housing 22. The operator can adjust the amount of oil discharged from the oil pump 52 by inserting a tool through the adjustment opening 114 and rotating the adjustment pin 112.

Next, the bolt 82 illustrated in FIG. 6 will be described in detail. The bolt 82 is constituted of a metallic material. The metallic material is, for example, iron. The bolt 82 is fixed to the right housing 12 by insert molding. The bolt 82 has a cylindrical shape extending in the left-right direction. The bolt 82 includes an outer portion 120, a fixed portion 122, and an inner portion 124. The outer portion 120 protrudes rightward from the right surface of the right housing 12. The outer portion 120 penetrates the long hole 6*a* disposed in the guide bar 6. An external screw portion 120*a* is formed on an outer peripheral surface of the outer portion 120 at the vicinity of its right end. An internal screw portion 84*a* formed on an inner peripheral surface of the nut 84 is screwed onto the external screw portion 120*a*, by which the nut 84 is attached to the outer portion 120. When the nut 84 is attached to the outer portion 120, the sprocket cover 20, the outer guide plate 78, the guide bar 6, the inner guide plate 76, and a washer 118 are held and fixed between the nut 84 and the right housing 12.

The fixed portion 122 is disposed leftward of the outer portion 120. The fixed portion 122 penetrates the right housing 12 from the right surface to the inner surface (that is, penetrates the oil tank 50 from the outside to the inside). The fixed portion 122 is in contact with the right housing 12 without any gap therebetween. The fixed portion 122 has a recess 128 in the vicinity of its center in the left-right direction. The recess 128 is recessed inward from its outer peripheral surface in the radial direction of the fixed portion 122. When the right housing 12 is molded integrally with the bolt 82 by insert molding, the resin material enters the recess 128, so that the fixed portion 122 is fitted and firmly fixed to the right housing 12. Even when the operator applies an excessive force to the nut 84 using a jig such as a wrench when fixing the guide bar 6 to the right housing 12, it is possible to suppress the bolt 82 from being detached from the right housing 12.

The inner portion 124 is disposed leftward of the fixed portion 122. The inner portion 124 is disposed inside the oil tank 50. The inner portion 124 extends to a position away from the inner surface of the oil tank 50 by a first distance L1 in the left-right direction. In the present embodiment, the first distance L1 is 5% or more and 10% or less of a length Lo of the oil tank 50 in the left-right direction. Here, the length Lo of the oil tank 50 in the left-right direction is the length from the welded portion between the right end of the oil tank 50 and the right housing 12 to the left end of the oil tank 50. The inner portion 124 is disposed in the vicinity of the center of the oil tank 50 in the front-rear direction. As illustrated in FIG. 8, the inner portion 124 is spaced from and disposed above the lower surface of the oil tank 50, and is disposed above the end of the entrance guide pipe 106.

The upper end portion of the inner portion 124 is disposed upward of the upper end of the refill opening 100 of the oil tank 50, and the lower end of the inner portion 124 is disposed downward of the upper end of the refill opening 100 and upward of the lower end of the refill opening 100. A fixing hole 126 recessed rightward is defined in the left end surface of the inner portion 124.

The chain saw 2 further includes a heat dissipating structure 130. The heat dissipating structure 130 includes a heat dissipating member 132 and a fixing bolt 142. In the present embodiment, the heat dissipating member 132 comprises heat dissipating fins. Hereinafter, the heat dissipating fins will be described with the same reference sign as that of the heat dissipating member 132. The heat dissipating fins 132 are constituted of a metallic material. As the metallic material, a material having high heat transfer performance such as aluminum is used. The heat dissipating fins 132 are disposed inside the oil tank 50. The heat dissipating fins 132 include a base portion 134, a plurality (three in the present embodiment) of upper fins 136, and a plurality (four in the present embodiment) of lower fins 138. The base portion 134 has a flat plate shape extending in the up-down direction. The base portion 134 has a fixing hole 140 penetrating in the left-right direction. In the state where the fixing bolt 142 is inserted into the fixing hole 140 of the base portion 134 and the fixing hole 126 of the inner portion 124, the fixing bolt 142 is screwed into the base portion 134 and the inner portion 124. As a result, the base portion 134 comes into contact with and fixed to the inner portion 124. The upper end of the base portion 134 is disposed upward of the refill opening 100, and the lower end of the base portion 134 is disposed downward of the refill opening 100.

Each of the upper fins 136 has a flat plate shape. The three upper fins 136 are disposed above the fixing hole 140. The three upper fins 136 are arranged side by side in the up-down direction. A wide surface of each of the upper fins 136 faces a wide surface of an adjacent upper fin 136. The three upper fins 136 are disposed upward of the refill opening 100 of the oil tank 50. The three upper fins 136 extend leftward from the left surface of the base portion 134. Each of the three upper fins 136 extends to a position away from the inner surface of the oil tank 50 by a second distance L2 in the left-right direction. The second distance L2 is longer than the first distance L1. The second distance L2 is 10% or more of the length Lo of the oil tank 50 in the left-right direction, and in the present embodiment, the second distance L2 is 40% of the length Lo of the oil tank 50 in the left-right direction. Further, in the present embodiment, all of the three upper fins 136 are arranged at positions away from the inner surface of the oil tank 50 by 10% or more of the length Lo of the oil tank 50 in the left-right direction with respect to the left-right direction in which the bolt 82 extends.

Each of the lower fins 138 has a flat plate shape. The four lower fins 138 are disposed at positions below the fixing hole 140. The four lower fins 138 are arranged side by side in the up-down direction. A wide surface of each of the lower fins 138 faces a wide surface of an adjacent lower fin 138. The lowermost lower fin 138 is disposed downward of the refill opening 100. The four lower fins 138 extend leftward from the left surface of the base portion 134. Each of the four lower fins 138 extends to a position away from the inner surface of the oil tank 50 by the second distance L2 in the left-right direction. In the present embodiment, the second distance L2 is 40% of the length Lo of the oil tank 50 in the left-right direction. In the present embodiment, all of the four lower fins 138 are arranged at positions away from the inner surface of the oil tank 50 by 10% or more of the length Lo of the oil tank 50 in the left-right direction with respect to the left-right direction in which the bolt 82 extends.

Next, positional relationships between a liquid surface of the oil in the oil tank 50 and the heat dissipating structure 130 will be described. While working by using the chain saw 2, the worker places the chain saw 2 in the same posture as when the chain saw 2 is placed on the placement surface P. In this state, as the oil amount in the oil tank 50 increases, the liquid surface of the oil is located further from the lower surface of the oil tank 50. As illustrated in FIG. 8, when the oil amount in the oil tank 50 is an amount corresponding to 90% of the capacity of the oil tank 50, the liquid surface LH 90 of the oil is located above the upper end of the uppermost upper fin 136. All three upper fins 136 and four lower fins 138 are disposed in the oil. When the oil amount is an amount corresponding to 50% of the capacity of the oil tank 50, the liquid surface LH 50 of the oil is located below the fixing bolt 142 and above the upper end of the uppermost lower fin 138. The four lower fins 138 are disposed in the oil, while the three upper fins 136 are not disposed in the oil. When the oil amount is an amount corresponding to 10% of the capacity of the oil tank 50, the liquid surface LH 10 of the oil is located between the upper end and the lower end of the lowermost lower fin 138. A part of the lowermost lower fin 138 is disposed in the oil, while the other three lower fins 138 and the three upper fins 136 are not disposed in the oil tank 50.

In addition, while working by using the chain saw 2, the worker may place the chain saw 2 in a posture in which the left housing 10 faces downward (that is, a posture in which the refill opening 100 faces downward.). In this state, as the oil amount in the oil tank 50 increases, the liquid surface of the oil is located further from the refill opening 100. As illustrated in FIG. 6, when the oil amount in the oil tank 50 is an amount corresponding to 50% of the capacity of the oil tank 50, the liquid surface LS 50 of the oil is located at a position further from the refill opening 100 than the ends of the three upper fins 136 and the ends of the four lower fins 138 are. When the oil amount is an amount corresponding to 40% of the capacity of the oil tank 50, the liquid surface LS 40 of the oil is located at a position further from the refill opening 100 than the ends of the three upper fins 136 and the ends of the four lower fins 138 are, by which a part of each of the fins 136 and each of the fins 138 can remain in the oil. In a variant, when the oil amount is an amount corresponding to 10% of the capacity of the oil tank 50, the three upper fins 136 and the four lower fins 138 may extend such that the three upper fins 136 and the four lower fins 138 are positioned closer to the refill opening 100 than the oil surface.

When an object to be cut is cut using the chain saw 2, frictional heat between the guide bar 6 and the saw chain 8 causes the guide bar 6 to have a high temperature. Thereafter, the heat of the guide bar 6 is transferred to the nut 84 and the bolt 82. As described above, in the state where the chain saw 2 is in the same posture as when the chain saw 2 is placed on the placement surface P or in the state where the left housing 10 faces downward, at least a part of each of the three upper fins 136 and each of the four lower fins 138 is disposed in the oil in the oil tank 50. Therefore, the heat of the bolt 82 is dissipated to the oil via the three upper fins 136 and the four lower fins 138. As a result, the nut 84 is suppressed from having a high temperature. The heat of the bolt 82 is transferred to the oil, so that the temperature of the oil increases and the viscosity of the oil decreases. For example, even when the chain saw 2 is used in an environment with a low outside temperature, such as in winter, the oil having a reduced viscosity can be supplied to the saw chain 8.

(Effect)

The chain saw 2 of the present embodiment comprises: the saw chain 8; the guide bar 6 to which the saw chain 8 is attached; the sprocket 70 configured to run the saw chain 8 along the periphery of the guide bar 6; the motor 48 configured to rotate the sprocket 70; the oil tank 50 configured to store oil to be supplied to the saw chain 8; the body housing 22 that houses the motor 48 and the oil tank 50; the bolt 82 protruding from the body housing 22 and penetrating the long hole 6*a* disposed in the guide bar 6; the nut 84 screwed onto the bolt 82 to fix the guide bar 6 to the body housing 22; and the heat dissipating structure 130 configured to dissipate heat from the bolt 82 to the oil in the oil tank 50.

In the above configuration, the heat of the nut 84 is transferred to the bolt 82, and the heat dissipating structure 130 dissipates the heat of the bolt 82 to the oil in the oil tank 50, so that it is possible to suppress the bolt 82 from having a high temperature. As a result, it is possible to suppress the nut 84 from having a high temperature.

Further, as illustrated in FIG. 8, the heat dissipating structure 130 comprises the heat dissipating member 132, wherein at least a part of the heat dissipating member 132 is disposed in the oil tank 50.

In the above configuration, at least a part of the heat dissipating member 132 is in contact with the oil in the oil tank 50, by which the heat of the heat dissipating member 132 is dissipated to the oil. Therefore, it is possible to suppress the nut 84 from having a high temperature.

The heat dissipating member 132 comprises the heat dissipating fins 132 constituted of a metallic material.

In the above configuration, as compared with the case where the heat dissipating member 132 does not include the heat dissipating fins, an area where the heat dissipating member 132 is in contact with the oil in the oil tank 50 can be increased, so that the heat of the heat dissipating member 132 is easily dissipated to the oil. Therefore, it is possible to further suppress the nut 84 from having a high temperature.

The liquid surface of the oil is located above the lower end of the at least a part of the heat dissipating member 132 in the state in which the chain saw 2 is placed on the ground surface when the oil having an oil amount corresponding to the first ratio (e.g., 50%) of the capacity of the oil tank 50 is stored in the oil tank 50.

In the above configuration, if the oil tank 50 stores the oil having the oil amount corresponding to the first ratio of the capacity of the oil tank 50, the heat dissipating member 132 can come into contact with the oil in the oil tank 50 when the chain saw 2 is in the same posture as when the chain saw 2 is placed on the placement surface P, so that the heat of the heat dissipating member 132 can be easily dissipated to the oil. Therefore, it is possible to further suppress the nut 84 from having a high temperature.

Further, the liquid surface of the oil is also located above the lower end of the at least a part of the heat dissipating member 132 in the state in which the chain saw 2 is placed on the ground surface when the oil having an oil amount corresponding to equal to or less than 50% of the capacity of the oil tank 50 is stored in the oil tank 50.

In order to suppress shortage of the oil in the oil tank 50 while working by using the chain saw 2, a sufficient amount of oil is usually stored in the oil tank 50. However, when the chain saw is continuously used for a long period of time, the amount of oil in the oil tank 50 may decrease to an amount corresponding to equal to or less than 50% of the capacity of the oil tank 50. In the above configuration, even when the chain saw 2 is continuously used for a long period of time, the heat dissipating member 132 can be brought into contact with the oil in the oil tank 50 when the chain saw 2 is placed in the same posture as when the chain saw 2 is placed on the placement surface P, and the heat of the heat dissipating member 132 can be easily dissipated to the oil. Therefore, it is possible to further suppress the nut 84 from having a high temperature.

The at least a part of the heat dissipating member 132 includes a portion disposed in the oil tank 50 and disposed away from the inner surface of the oil tank 50 by at least 10% of the length Lo of the oil tank 50 with respect to the direction in which the bolt 82 extends.

In the above configuration, by disposing the at least a part of the heat dissipating member 132 in a position deep in the oil tank 50, an area where the heat dissipating member 132 is in contact with the oil in the oil tank 50 can be increased, so that the heat of the heat dissipating member 132 can be easily dissipated to the oil. As a result, it is possible to further suppress the nut 84 from having a high temperature.

As illustrated in FIG. 3, the guide bar 6 comprises the cutting part 7*b* disposed between the body housing 22 and the front end of the guide bar 6 in the longitudinal direction of the guide bar 6. The length Lg of the cutting part 7*b* in the longitudinal direction is equal to or less than 250 mm.

Generally, the shorter the length Lg of the cutting part 7*b*, the greater the curvature of the periphery of the guide bar 6. For this reason, frictional heat between the saw chain 8 and the guide bar 6 increases, and the guide bar 6 tends to have a higher temperature. In the above configuration, the heat transferred from the guide bar 6 having a higher temperature to the bolt 82 can be dissipated to the oil in the oil tank 50 through the heat dissipating structure 130. As a result, it is possible to suppress the nut from 84 from having a high temperature.

The motor 48 may function as a prime mover.

In the above configuration, as compared with the case where the prime mover is an engine, the body housing 22 does not tend to have portion(s) having a high temperature, and thus there is a high risk that the operator touches the nut without paying attention. In the above configuration, since the heat dissipating structure 130 dissipates the heat of the bolt 82 to the oil in the oil tank 50, it is possible to suppress the nut 84 from having a high temperature.

As illustrated in FIG. 1, the chain saw 2 further comprises the battery pack B configured to be detachably attached to the body housing 22. The motor 48 is configured to operate using electric power supplied from the battery pack B.

In the above configuration, since the power cable is unnecessary, it is easy to handle the chain saw 2, but there is a high risk that the operator touches the nut 84 without paying attention. In the above configuration, since the heat dissipating structure 130 dissipates the heat of the bolt to the oil in the oil tank 50, it is possible to suppress the nut 84 from having a high temperature.

Second Embodiment

Figure 9:
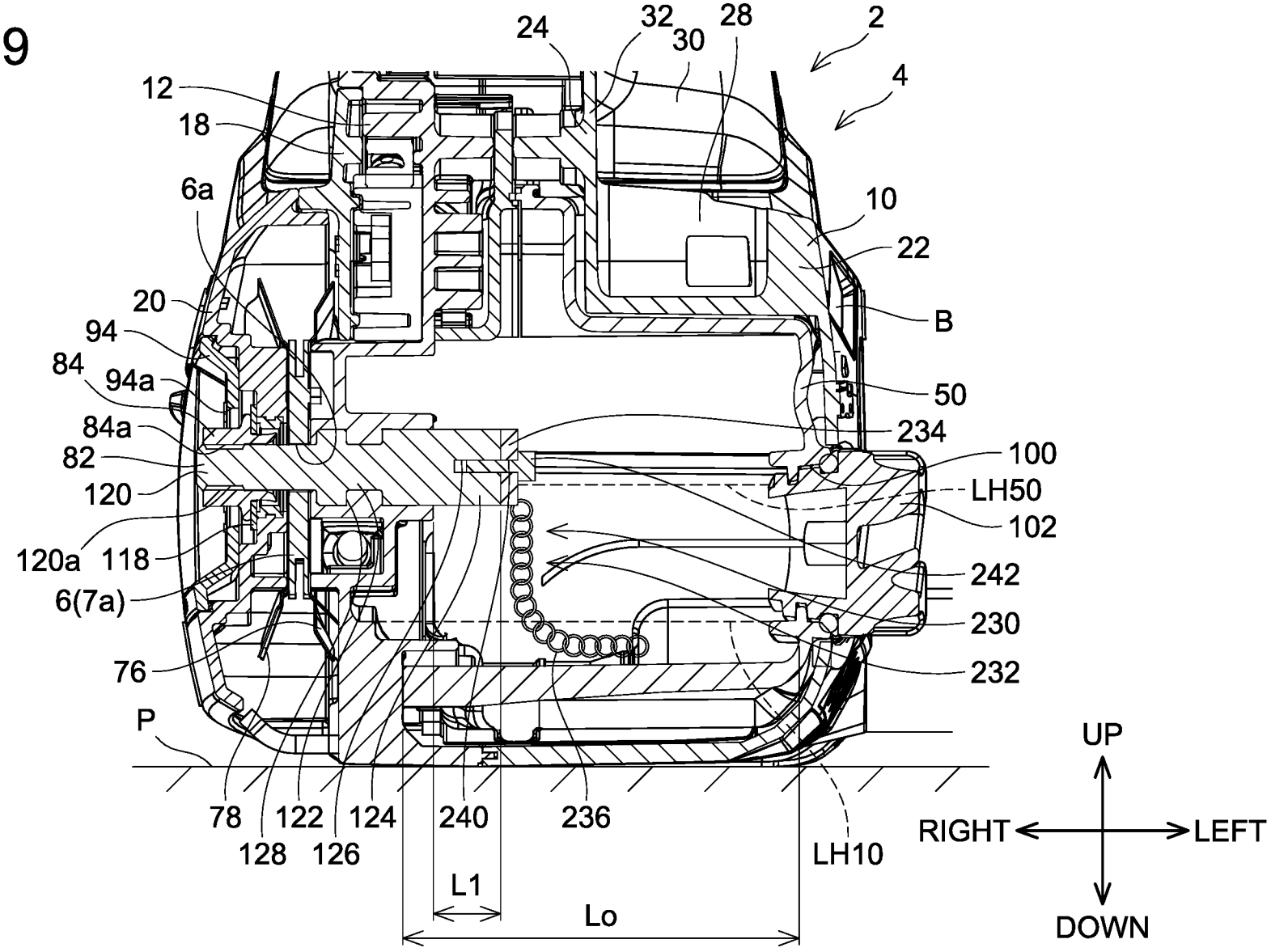
FIG. 9 is a vertical cross-sectional view of the chain saw 2 of a second embodiment.

A second embodiment will be described with reference to FIGS. 9 and 10. In the second embodiment, differences from the first embodiment will only be described, and the same points as those of the first embodiment will be denoted by the same reference signs, and description thereof will be omitted. In the second embodiment, a configuration of a heat dissipating structure 230 is different from that of the heat dissipating structure 130 of the first embodiment. As illustrated in FIG. 9, the heat dissipating structure 230 includes a heat dissipating member 232 and a fixing bolt 242. The heat dissipating member 232 comprises a flexible member. Hereinafter, the flexible member will be described with the same reference sign as that of the heat dissipating member 232. The flexible member 232 is constituted of a metallic material. As the metallic material, a material having high heat transfer performance such as aluminum is used. The flexible member 232 is disposed inside the oil tank 50. The flexible member 232 includes a base portion 234 and a chain portion 236. The base portion 234 has a fixing hole 240 penetrating in the left-right direction at its central portion in the up-down direction. In the state where the fixing bolt 242 is inserted into the fixing hole 240 of the base portion 234 and the fixing hole 126 of the inner portion 124, the fixing bolt 242 is screwed into the base portion 234 and the inner portion 124. As a result, the base portion 234 comes into contact with and fixed to the inner portion 124.

The chain portion 236 is fixed to a lower portion of the base portion 234. The chain portion 236 has a shape in which a plurality of metallic rings is connected. The chain portion 236 hangs in the direction of gravity regardless of the posture of the chain saw 2. For example, as illustrated in FIG. 9, when the chain saw 2 is in the same posture as when the chain saw 2 is placed on the placement surface P, the chain portion 236 hangs toward the lower surface of the oil tank 50, and a part of the chain portion 236 is in contact with the lower surface of the oil tank 50. In this state, even when the oil amount in the oil tank 50 is an amount corresponding to 10% of the capacity of the oil tank 50, the liquid surface LH 10 of the oil is located above a part of the chain portion 236. Therefore, a part of the chain portion 236 is disposed in the oil. As a result, the heat of the bolt 82 is dissipated to the oil via the chain portion 236, and it is possible to suppress the nut 84 from having a high temperature.

Figure 10:
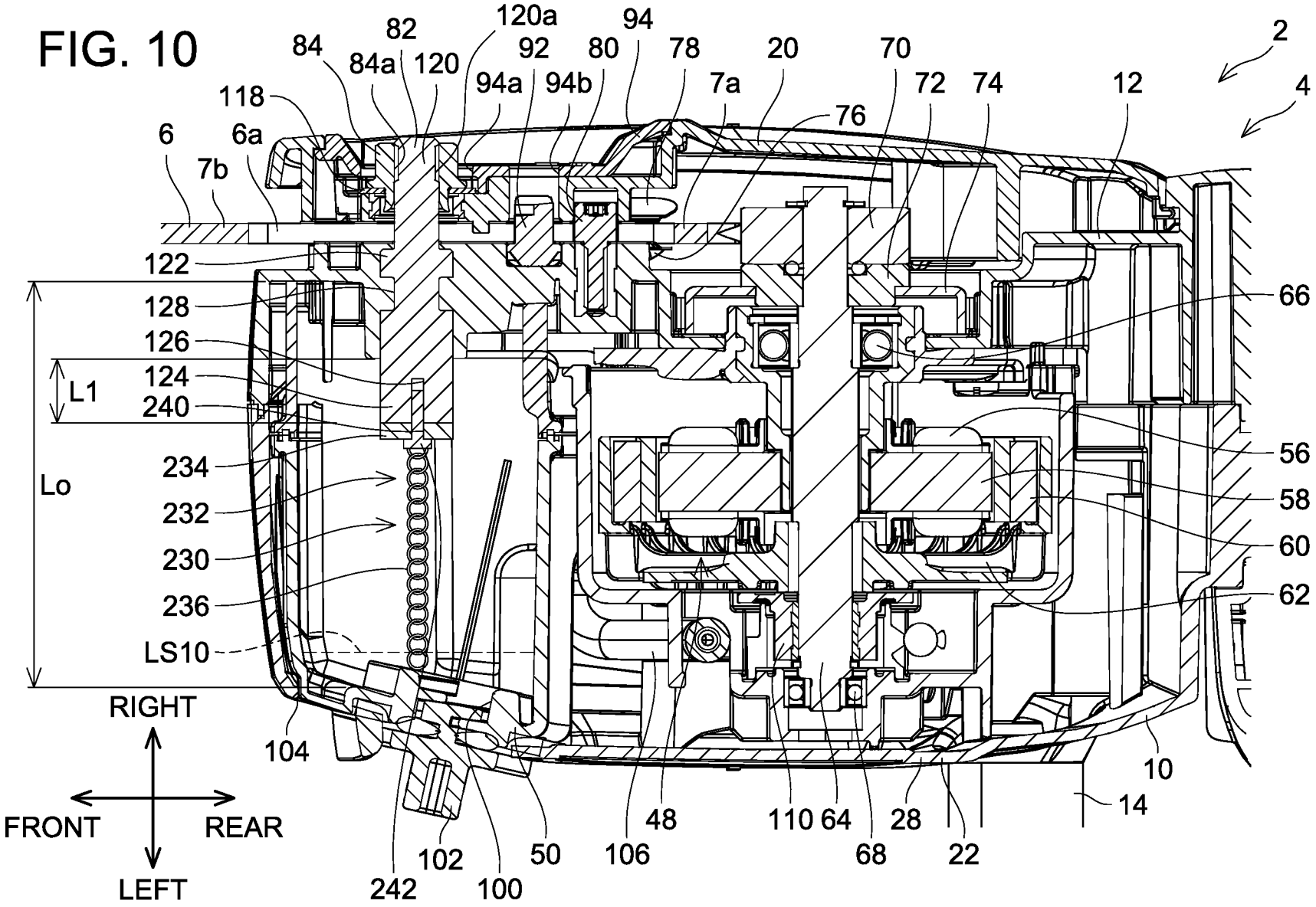
FIG. 10 is a horizontal cross-sectional view of the chain saw 2 of the second embodiment.

When the refill opening 100 as illustrated in FIG. 10 faces downward, the chain portion 236 hangs toward the refill opening 100, and a part of the chain portion 236 is in contact with the inner surface of the oil tank 50 on the refill opening 100 side. Therefore, even when the oil amount in the oil tank 50 is an amount corresponding to 10% of the capacity of the oil tank 50, the liquid surface LS 10 of the oil is located at a position further from the refill opening 100 than the part of the chain portion 236 is. As a result, the heat of the bolt 82 is dissipated to the oil via the chain portion 236 disposed in the oil, and it is possible to suppress the nut 84 from having a high temperature.

(Effect)

The heat dissipating member 232 is the flexible member 232 constituted of a metallic material and hanging in the direction of gravity regardless of the posture of the chain saw 2.

In the above configuration, since the flexible member 232 can come into contact with the oil in the oil tank 50 regardless of the posture of the chain saw 2, the heat of the heat dissipating member 232 is easily dissipated to the oil. Therefore, it is possible to further suppress the nut 84 from having a high temperature.

Third Embodiment

Figure 11:
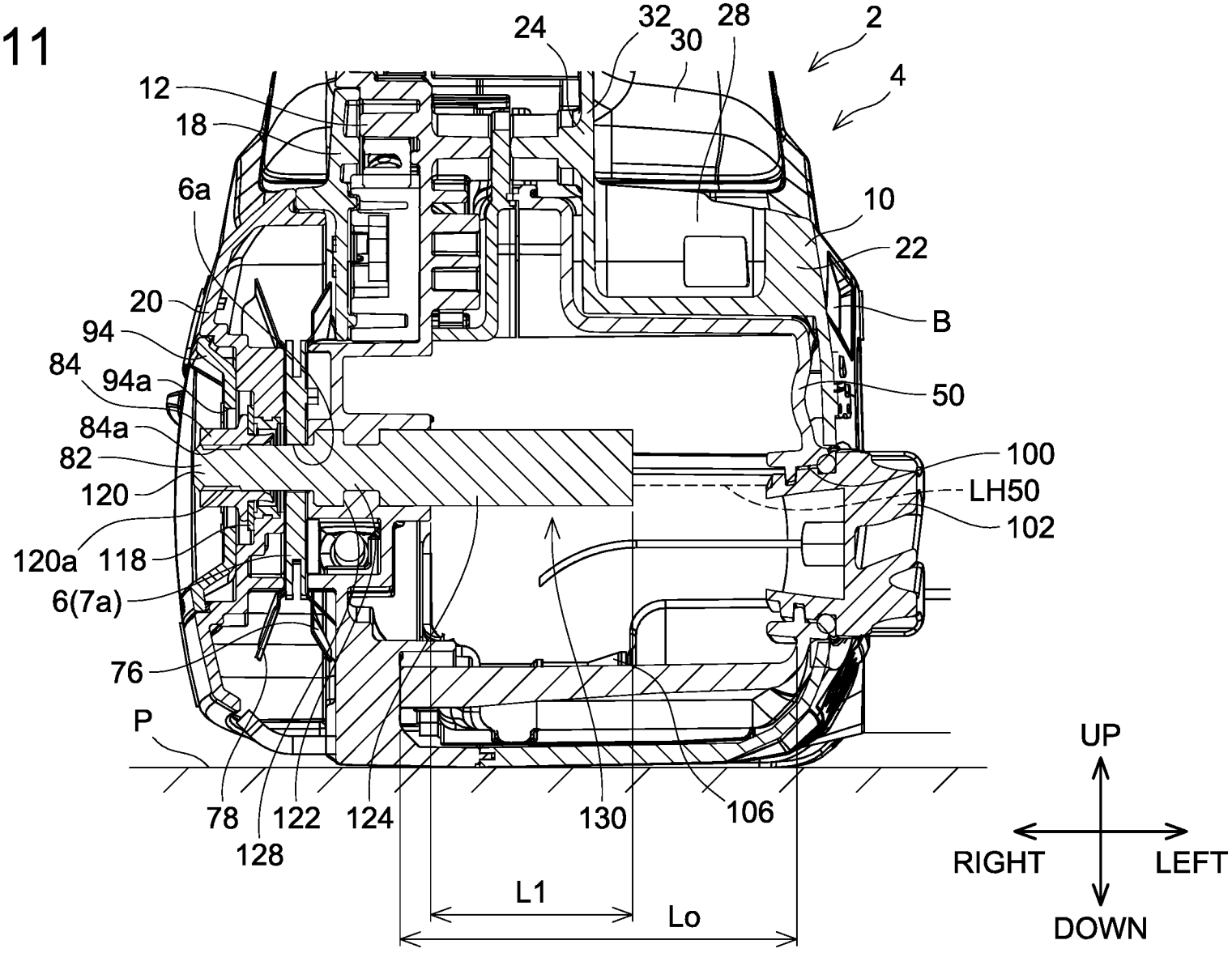
FIG. 11 is a vertical cross-sectional view of the chain saw 2 of a third embodiment.

A third embodiment will be described with reference to FIGS. 11 and 12. In the third embodiment, differences from the first embodiment will only be described, and the same points as those of the first embodiment will be denoted by the same reference signs, and description thereof will be omitted. As illustrated in FIG. 11, in the third embodiment, the inner portion 124 of the bolt 82 constitutes the heat dissipating structure 130. The inner portion 124 extends to a position away from the inner surface of the oil tank 50 by a first distance L1 in the left-right direction in which the fixed portion 122 of the bolt 82 extends. Here, the first distance L1 is 10% or more of a width W of the oil tank 50 in the left-right direction, and is 40% of the length Lo in the present embodiment. The upper end of the inner portion 124 is disposed upward of the upper end of the refill opening 100 of the oil tank 50, and the lower end of the inner portion 124 is disposed downward of the upper end of the refill opening 100 and upward of the lower end of the refill opening 100.

In the state where the chain saw 2 is in the same posture as when placed on the placement surface P, when the oil amount in the oil tank 50 is an amount corresponding to 50% of the capacity of the oil tank 50, the liquid surface LH 50 of the oil is disposed above the lower end of the inner portion 124. Therefore, a part of the inner portion 124 is disposed inside the oil. As a result, the heat of the bolt 82 is dissipated to the oil via the inner portion 124, and it is possible to suppress the nut 84 from having a high temperature.

Figure 12:
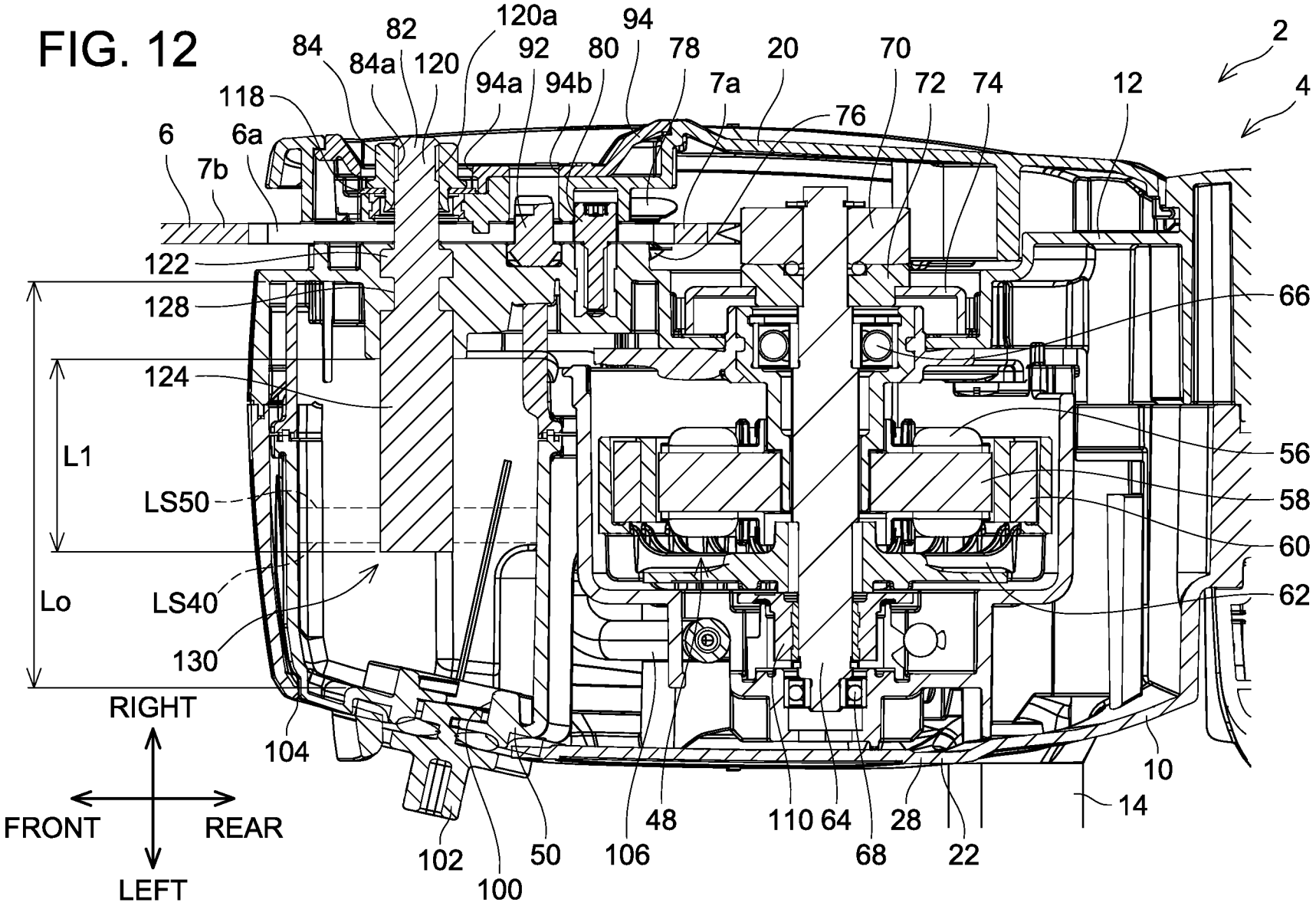
FIG. 12 is a horizontal cross-sectional view of the chain saw 2 of the third embodiment.

In the state where the refill opening 100 as illustrated in FIG. 12 faces downward, when the oil amount in the oil tank 50 is an amount corresponding to 50% of the capacity of the oil tank 50, the liquid surface LS 50 of the oil is located at a position further from the refill opening 100 than the end of the inner portion 124 is. In addition, when the oil amount is an amount corresponding to 40% of the capacity of the oil tank 50, the liquid surface LS 40 of the oil is located at a position further from the refill opening 100 than the end of the inner portion 124 is, by which a part of the inner portion 124 can remain in the oil. In a variant, when the oil amount is an amount corresponding to 10% of the capacity of the oil tank 50, the inner portion 124 may extend to a position below the liquid surface of the oil.

(Effect)

The bolt 82 penetrates the oil tank 50 from the outside of the oil tank 50 to the inside of the oil tank 50. The inner portion 124 of the bolt 82 inside the oil tank 50 constitutes the heat dissipating structure 130. The portion 124 of the bolt 82 inside the oil tank 50 includes the portion disposed in the oil tank 50 and disposed away from the inner surface of the oil tank 50 by at least 10% of the length Lo of the oil tank 50 with respect to the direction in which the bolt 82 extends.

In the above configuration, by disposing the bolt 82 in a position deep inside the oil tank 50, an area where the bolt 82 is in contact with the oil in the oil tank 50 can be increased, so that the heat of the bolt 82 can be easily dissipated to the oil. As a result, it is possible to further suppress the nut 84 from having a high temperature.

The liquid surface of the oil is located above the lower end of the portion of the bolt 82 inside the oil tank 50 in the state in which the chain saw 2 is placed on the ground surface when the oil having the oil amount corresponding to the first ratio (e.g., 50%) of the capacity of the oil tank 50 is stored in the oil tank 50.

In the above configuration, if the oil having the oil amount corresponding to the first ratio of the capacity of the oil tank is stored in the oil tank 50, the bolt 82 can come into contact with the oil in the oil tank 50 when the chain saw 2 is in the same posture as when the chain saw 2 is placed on the placement surface P, so that the heat of the bolt 82 can be easily dissipated to the oil. As a result, it is possible to further suppress the nut 84 from having a high temperature.

Further, the liquid surface of the oil is located above of the lower end of the at least a part of the heat dissipating member 232 in the state in which the chain saw 2 is placed on the ground surface when the oil having an oil amount corresponding to equal to or less than 50% of the capacity of the oil tank 50 is stored in the oil tank 50.

In the above configuration, even when the chain saw 2 is continuously used for a long period of time and the oil amount in the oil tank 50 decreases to 50% or less of the capacity of the oil tank 50, the bolt 82 can be brought into contact with the oil in the same posture as when the chain saw 2 is placed on the placement surface P, and the heat of the bolt 82 can be easily dissipated to the oil. As a result, it is possible to further suppress the nut 84 from having a high temperature.

In the present embodiment, the heat of the bolt 82 can be dissipated to the oil only by the bolt 82. Accordingly, the number of components can be reduced.

The fixed portion 122 of the bolt 82 according to an embodiment may extend leftward from the outer portion 120, then bend and extend downward, and then further bend and extend leftward. In this case, the inner portion 124 may extend in the left-right direction in the vicinity of the lower surface of the oil tank 50.

The bolt 82 according to an example may comprise only the outer portion 120 and the fixed portion 122. In this case, the heat dissipating structures 130, 230 may be directly fixed to the fixed portion 122. In addition, both the bolt 82 and the heat dissipating structures 130, 230 may be fixed to the right housing 12 by insert molding. In this case, a part of the heat dissipating structures 130, 230 may be buried in the right housing 12.

The chain saw 2 according to an embodiment may be an engine-driven chain saw.

The chain saw 2 according to an embodiment may not include the battery pack B. In this case, the chain saw 2 may be configured to supply electric power from an external power supply to the motor 48 via a power cable.

What is claimed is:

1. A chain saw comprising:

a saw chain;

a guide bar to which the saw chain is attached;

a sprocket configured to run the saw chain along a periphery of the guide bar;

a prime mover configured to rotate the sprocket;

an oil tank configured to store oil to be supplied to the saw chain;

a housing that houses the prime mover and the oil tank;

a bolt protruding from the housing and penetrating a hole disposed in the guide bar;

a nut screwed onto the bolt to fix the guide bar to the housing; and a heat dissipating structure configured to dissipate heat from the bolt to the oil in the oil tank.

2. The chain saw according to claim 1, wherein the heat dissipating structure comprises a heat dissipating member attached to and extending from a lower portion of the bolt, wherein at least a part of the heat dissipating member is disposed in the oil tank.

3. The chain saw according to claim 2, wherein the heat dissipating member comprises a heat dissipating fin constituted of a metallic material.

4. The chain saw according to claim 2, wherein a liquid surface of the oil is located above a lower end of the at least a part of the heat dissipating member in a state in which the chain saw is placed on a ground surface when the oil having an oil amount corresponding to a first ratio of a capacity of the oil tank is stored in the oil tank.

5. The chain saw according to claim 4, wherein the first ratio is 50% of the capacity of the oil tank.

6. The chain saw according to claim 2, wherein part of the heat dissipating member disposed in the oil tank extends from an inner surface of the oil tank to at least 10% of a length of the oil tank with respect to a direction in which the bolt extends.

7. The chain saw according to claim 1, wherein the bolt penetrates the oil tank from an outside of the oil tank to an inside of the oil tank, a portion of the bolt inside the oil tank constitutes the heat dissipating structure, and the portion of the bolt inside the oil tank includes a portion disposed in the oil tank and extending from an inner surface of the oil tank by at least 10% of a length of the oil tank with respect to a direction in which the bolt extends.

8. The chain saw according to claim 7, wherein a liquid surface of the oil is located above a lower end of the portion of the bolt inside the oil tank in a state in which the chain saw is placed on a ground surface when the oil having an oil amount corresponding to a first ratio of a capacity of the oil tank is stored in the oil tank.

9. The chain saw according to claim 8, wherein the first ratio is equal to or less than 50% of the capacity of the oil tank.

10. The chain saw according to claim 1, wherein the guide bar comprises a cutting part disposed between the housing and a front end of the guide bar in a longitudinal direction of the guide bar, and a length of the cutting part in the longitudinal direction is equal to or less than 250 mm.

11. The chain saw according to claim 1, wherein the prime mover is a motor.

12. The chain saw according to claim 11, further comprising a battery pack configured to be detachably attached to the housing, wherein the motor is configured to operate using electric power supplied from the battery pack.

* * * * *